US008137480B2

(12) United States Patent
Grabher

(10) Patent No.: US 8,137,480 B2
(45) Date of Patent: Mar. 20, 2012

(54) METHOD AND DEVICE FOR FLUSHING CONTAINERS WITH INERT GAS

(76) Inventor: Werner Grabher, Balgach (CH)

( * ) Notice: Subject to any disclaimer, the term of this patent is extended or adjusted under 35 U.S.C. 154(b) by 0 days.

(21) Appl. No.: 12/435,875

(22) Filed: May 5, 2009

(65) Prior Publication Data

US 2010/0064639 A1 Mar. 18, 2010

Related U.S. Application Data

(63) Continuation of application No. 10/512,441, filed as application No. PCT/EP03/03951 on Apr. 16, 2003, now abandoned.

(30) Foreign Application Priority Data

Apr. 24, 2002 (EP) ..... 02009132

(51) Int. Cl.
*B08B 9/00* (2006.01)

(52) U.S. Cl. ..... 134/166 R; 53/79; 53/510; 134/137

(58) Field of Classification Search ..... None
See application file for complete search history.

(56) References Cited

U.S. PATENT DOCUMENTS

| | | | |
|---|---|---|---|
| 2,127,964 | A | 8/1938 | Ryan et al. |
| 2,519,353 | A | 8/1950 | Cassady |
| 3,226,749 | A | 1/1966 | Ziche |
| 4,347,695 | A | 9/1982 | Zobel et al. |
| 4,729,204 | A | 3/1988 | Weiss |
| 5,060,449 | A | 10/1991 | Klarl |
| 5,284,871 | A | 2/1994 | Graf |
| 6,058,949 | A | 5/2000 | Engle |

FOREIGN PATENT DOCUMENTS

| | | | |
|---|---|---|---|
| DE | 3925952 | C | 6/1990 |
| EP | 0352382 | A | 1/1990 |

*Primary Examiner* — Michael Kornakov
*Assistant Examiner* — Eric Golightly
(74) *Attorney, Agent, or Firm* — Rothwell, Figg, Ernst & Manbeck, P.C.

(57) ABSTRACT

The invention relates to an inert gas flow which is directed through a channel. The channel includes walls (19,21) which limit the flow. A container having a charging inlet is fed through a recess (10) which is arranged in the first wall (21) adjacent to the flow. According to the invention, the channel includes limiting structures for the flow which are arranged in the area opposite the recess and the first wall can be displaced in a parallel manner in relation to the limiting structures. The channel, together with the container, forms a closed inert gas rinsing chamber.

8 Claims, 2 Drawing Sheets

METHOD AND DEVICE FOR FLUSHING CONTAINERS WITH INERT GAS

CROSS-REFERENCE TO RELATED APPLICATION

This application is a continuation of U.S. patent application Ser. No. 10/512,441, filed Jun. 13, 2005, which is a National Phase of International Application Serial No. PCT/EP03/03951, filed Apr. 16, 2003 and also claims the benefit of European Application No. 02009132.8, filed Apr. 24, 2002, each of which is incorporated by reference in their entirety.

FIELD OF THE INVENTION

The invention relates to a method and a device for flushing containers, in particular for food, with inert gas.

DESCRIPTION OF THE BACKGROUND ART

It is known that certain products, in particular food products, are impaired by oxygen and/or atmospheric humidity. They are therefore stored in an artificial atmosphere comprising a reduced oxygen and/or water vapour content.

For foods which are stored in flexible containers, a customary packaging method comprises evacuating the packaging containing the products and then sealing it gas-tight. This method is not possible in the case of containers having thin, in particular semirigid, walls, such as, for example, cans, cups or trays, since such containers do not as a rule withstand the forces which occur during evacuation.

Containers can be evacuated in a known manner in a vacuum chamber and then flushed with an inert gas, for example nitrogen. This multistage method requires a considerable outlay in terms of apparatus, energy and time. Only very sensitive and high-quality food products, such as, for example, milk powder, justify the use of such methods.

U.S. Pat. No. 2,519,353 discloses a sealing station for a filled tin can, in which a device for flushing the head space of the can with steam is integrated. The device has a flow channel for steam. It is formed by walls of the device and the can lid to be mounted on the can. The can lid is introduced into a hole in a wall of the channel. A controlled flow over the head space of the can from one side to the opposite side of the can opening is ensured through the channel. By means of such a flow, controlled gas exchange—without uncontrolled turbulence—takes place in the head space. Consequently, uniform evacuation of the air from the head space can be achieved. Air exchange carried out in this manner requires not only the closure element but also sealing of the can on the same station.

DE 3925952 C1 furthermore discloses a vessel sealing machine in which the filled glass bottles—driven by a continuously rotating turnstile—move around a circular path. The head space thereof is flushed with inert gas and closed with a crown cork. The flow chambers through which the inert gas flows are formed by two parallel walls which are fastened to the turnstile. The lower and the upper wall each have a passage for the bottleneck or crown cork pushed into the chamber. This vessel sealing machine is suitable for the gassing and direct sealing of rapidly revolving, filled glass bottles.

SUMMARY OF THE INVENTION

It is the object of the invention to provide a method and a device, by means of which method and which device flushing with inert gas is permitted for various types of container, for example cans. In addition, it should be possible to use this method more flexibly in comparison with flushing with inert gas and subsequent sealing on the same processing station. Not least, it is intended to propose flushing of containers with inert gas, which flushing is coordinated with a plurality of stations of a processing position for containers, which stations are arranged in particular in the form of a ring.

This object is achieved by a method and a device.

Further advantageous or alternative developments of the invention are described.

When the term container is used in connection with the invention, it is intended to mean a container which has at least one rigid or semirigid wall. In particular, it is to be understood as meaning cans which have a substantially tubular wall. This wall is sealed gas-tight at one end and, after filling, is to be sealed gas-tight at the other end by means of a closure element.

In the method according to the invention for flushing a container with inert gas, inert gas flows on one side into a channel bounded by walls and flows out thereof again on the other side. The container is fed with its flushing opening through a passage in a first wall bounding the channel, towards the flowing inert gas, so that, in the edge region of the filling opening, the inert gas flows in and out substantially parallel to the area of the filling opening. According to the invention, the channel has, in the region opposite the passage, limiting means for the flow. These means may be in the form of a further wall, of a filling device or of a closure element.

Depending on the velocity and the amount of the flowing inert gas and on the duration of flushing with inert gas, gas is displaced from the can by the inert gas. It is thus possible to achieve a predetermined residual oxygen or residual water vapour content in the container or to achieve a content lower than said residual content. If a device for measuring the oxygen content is also provided in the device for flushing with inert gas, for example in the interior of the container, the predetermined value for the residual oxygen content can be achieved in a self-regulating manner through feedback to the adjusting elements which control the inert gas flow.

That wall of the channel which is opposite to the filling opening can be formed in such a way that at least a part of the inert gas flows in the channel over the filling opening, advantageously substantially in a single direction.

The inflowing inert gas advantageously has superatmospheric pressure, and the outflowing inert gas reduced pressure relative to the environment. In this way, the velocity of the flowing inert gas can be increased without a significant pressure increase in the container.

A device according to the invention has a plurality of walls which bound a channel. Inert gas flows into this channel at one end and out again at the other end. The channel has feed and discharge openings for the inert gas in the edge region of the filling opening. The inert gas flows in and out parallel to the area of the filling opening, via the edge region thereof. The inflowing and outflowing inert gas directed through the channel comes into contact with gas in the interior of the container via the filling opening. Gas from the interior of the container is thus replaced with inert gas. The channel and the interior of the container form a flushing chamber in which the flushing with inert gas takes place.

A development of the invention envisages a substantially slit-like, horizontally arranged channel for the inflowing and outflowing inert gas. The channel is bounded by an upper and a lower wall. A container to be flushed is fed through a passage in the lower wall towards the flowing inert gas. For flushing with inert gas, the container is fed perpendicularly to the direction of flow of the inert gas through the passage in the wall towards the inert gas flow. Such a device for flushing with inert gas can be made relatively flat and thus can also be installed on existing processing positions for containers.

Advantageously, containers fed towards the inert gas flow are connected via the outside of their tubular wall to the lower wall. Consequently, the inside of the tubular wall and the end face with the filling opening remain accessible for any processing operations. The tightness of the connection can be ensured by a sealing lip which rests against the tubular outside all round.

A further development of the invention provides for the coordination of a device for flushing with inert gas, which extends over a plurality of stations, with a plurality of stations which process containers synchronously. For example, it is possible thereby to flush out a can on an inert gas flushing station and to transport it under an inert gas atmosphere to a further station, for example a sealing station, without it being possible for ambient air to penetrate into the can. Furthermore, by means of such an inert gas flushing device distributed over a plurality of stations, the flushing process can be distributed over a plurality of stations and optionally over the transport distance between these stations. The advantages achievable thereby are obvious.

In particular, stations arranged in the form of a ring can be easily and reliably provided with a device for inert gas flushing, by means of a channel for the flowing inert gas, the lower wall of which, for example, is movable and the upper wall of which is stationary.

Another development of the invention provides a movable lower wall and a movable upper wall—for example in the form of two perforated discs. The two perforated discs are held apart by means of wedge-shaped spacers pointing towards the centre and, together with the perforated discs, form walls bounding the inert gas flow.

BRIEF DESCRIPTION OF THE DRAWINGS

Below, the invention is described in more detail, purely by way of example, with reference to figures of the drawing. Identical parts in different embodiments which perform the same function are provided below with identical designations and reference numerals.

DETAILED DESCRIPTION OF THE INVENTION

Figure 1:
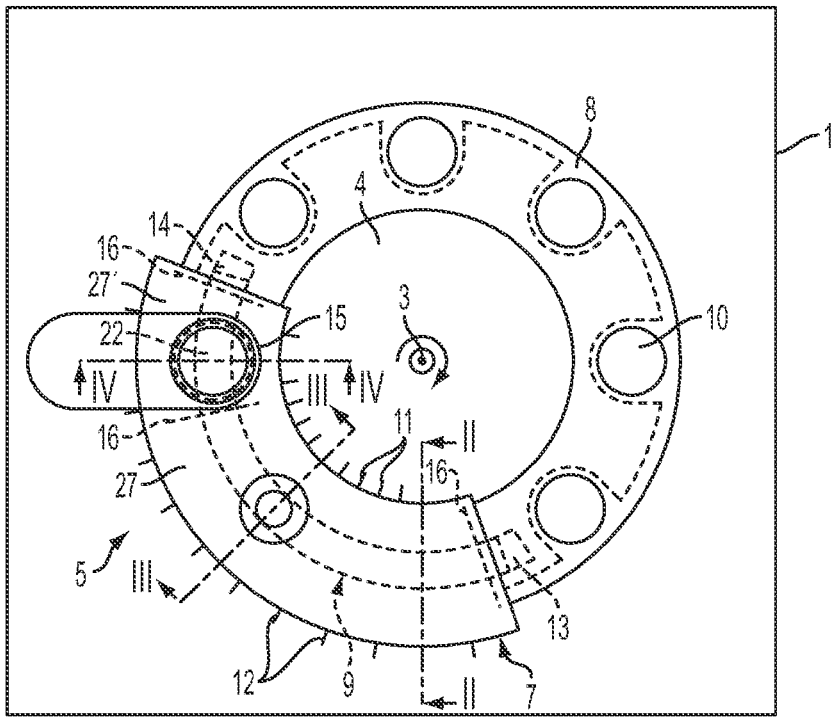
FIG. 1 shows a processing position for cans, comprising a plurality of stations, a turnstile and an embodiment of a device according to the invention for inert gas flushing, in plan view

FIG. 1 shows a processing position for containers in the form of cans, at a plurality of stations of which not shown in detail cans are processed synchronously. In addition to a table top 1, the stations and a conveying means in the form of a turnstile 4, the processing position has an embodiment of a device according to the invention for inert gas flushing 5 which flushes cans with inert gas at three stations.

Cans are transported from one station to the next in a manner known per se by rotation of the turnstile 4 about the axis 3 of rotation in the direction of the rotational arrow shown in FIG. 1. The cans are guided by a barrier 6 which is fastened to the table top 1.

Here, the device for inert gas flushing 5 has an upper housing 7, a perforated disc 8 rotatable about the axis 3 of rotation and a lifting device not shown in FIG. 1 and indicated by a dashed line.

The lifting device in the form of an arc-shaped lifting track 9 has a lifting ramp 13 at one end and a lowering ramp 14 at the other end for lifting a can to be sealed and for lowering a can provided with a closure element 22, respectively. Based on the direction of rotation of the turnstile 4, the two ramps 13 and 14 are arranged in the region before and after the upper part 7, respectively, and are connected by means of a curved rod which has a rectangular cross-section.

Here, the perforated disc 8 has the shape of an annular disc in which eight regularly arranged passages 10 are provided. A can be pushed into each of the passages 10. The perforated disc 8 is arranged above the turnstile 4 and coaxially therewith at a distance from the table top 1 which is predetermined by the height of the cans. In FIG. 1, the perforated disc 8 conceals the outer contour of the turnstile 4, which is indicated by a dashed line. The turnstile 4 and the perforated disc 8 execute the same rotational movements about the axis 3 of rotation. Cans which pass the lifting ramp 12 or the lowering ramp 13 while being transported from one station to the next are pushed into and out of the holes 10, respectively. This movement of the can relative to the perforated disc 8 is directed here perpendicularly to the transport direction. The cans are guided by the turnstile 4 and the barrier 6.

The upper housing 7 connected in a stationary manner to the table top 1 has a base shape in the form of an annular segment and grips around a part of the top 21 and of the inner and outer edge of the perforated disc 8. On the side facing the axis 3 of rotation and on that side of the upper housing 7 which faces away therefrom, inert gas feed pipes 11 and gas discharge pipes 12, respectively, are provided. At the position of the sealing station, which is not shown and which—based on the direction of rotation—is arranged at the end of the device, the top of the upper housing 7 has an introduction opening 15 into which a closure element 22 is inserted, and, shown only schematically, a feed for further closure elements by means of which further cans are to be sealed gas-tight. The space bounded by the upper housing 7 and the perforated disc 8 is bounded in the radial direction by three radial sealing lips 16 shown by means of dashed lines in FIG. 1. The sealing lips 16 are fastened to the upper housing 7 and here bound two channels 27 and 27' in the radial direction. The channels 27 and 27' direct the inflowing and outflowing inert gas.

Figure 2:
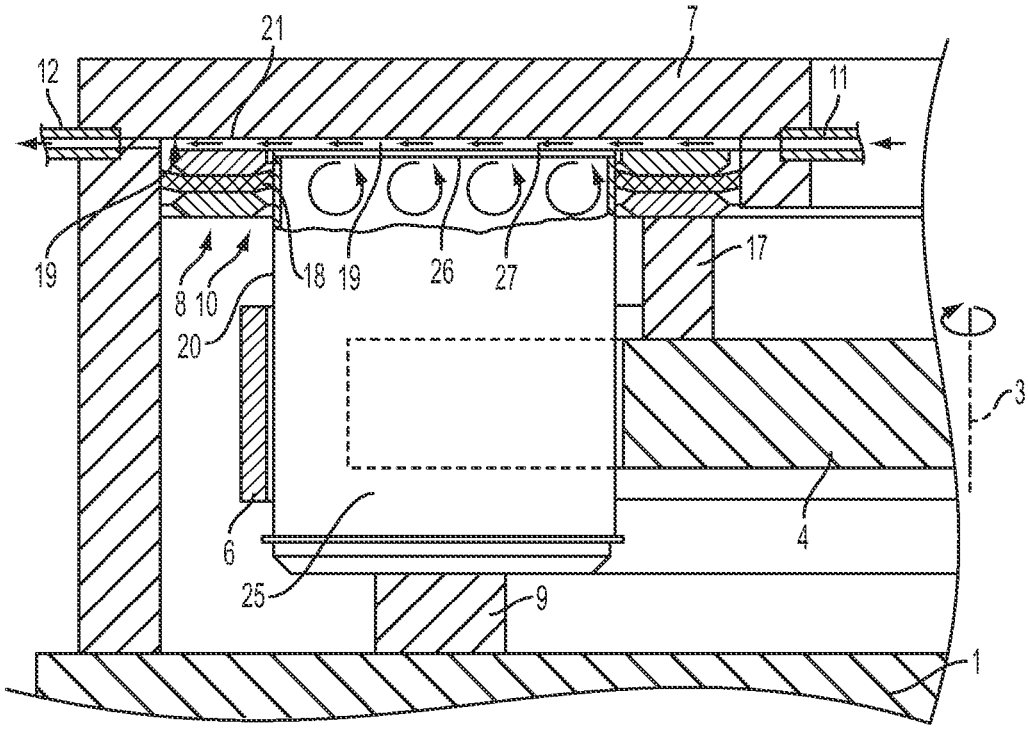
FIG. 2 shows a detailed view of the device from FIG. 1 in section (II-II), as a side view

FIG. 2 shows a detailed view of a station for inert gas flushing of the processing position shown in FIG. 1, as a section along the plane II-II, and a can 25 pushed via the lifting track 9 into a passage 10 and intended for sealing, as a partial section in side view. The upper housing 7 and the lifting track 9 are fastened on the table top 1 of the processing position. The perforated disc 8 is fastened to the turnstile 4 via a spacer ring 17. The perforated disc 8 has two retaining discs which are connected to one another and a sheet gasket 18 arranged between said retaining discs and projecting beyond the inner and outer edge of the perforated disc 8. In the region of the passages 10, the sheet gasket 18 has punched holes whose edges project into the passages 10. The sheet gasket 18 rests on the one hand against the insides of the upper housing 7 which face one another and on the other hand laterally against the tubular outside 20 of the can 25 which here has been positioned from below transversely to the transport direction.

The area of the filling opening 26 of the can 25 extends approximately to the top 21 of the perforated disc 8. The filling opening 26 could, however, also project slightly above this. The top 21 and the inner surface 19 of the upper housing 7, which surface is opposite the filling opening 26, bound a first channel 27 which directs the flowing inert gas. The can 25 is fed with its filling opening 26 towards the first channel 27. Inert gas flows into the first channel 27 via the inert gas feed pipe 11 and out thereof again via the gas discharge pipe 12. Inert gas is fed in on one side and discharged on the other side via this channel 27, in the edge region of the filling opening 26, substantially in a plane parallel to the area of the filling opening 26. Via the filling opening 26, at least a part of this flowing inert gas comes into contact with the gas present in the interior of the can 25 and flushes said gas out of the can 25.

A channel 27, together with the interior of an inserted can 25 which is connected to said channel via the filling opening 26, forms a substantially closed flushing space for the inert gas flushing. Of course, the effectiveness of the inert gas flushing is determined not least by the sealing of the flushing space from the environment of the device.

Figure 3:
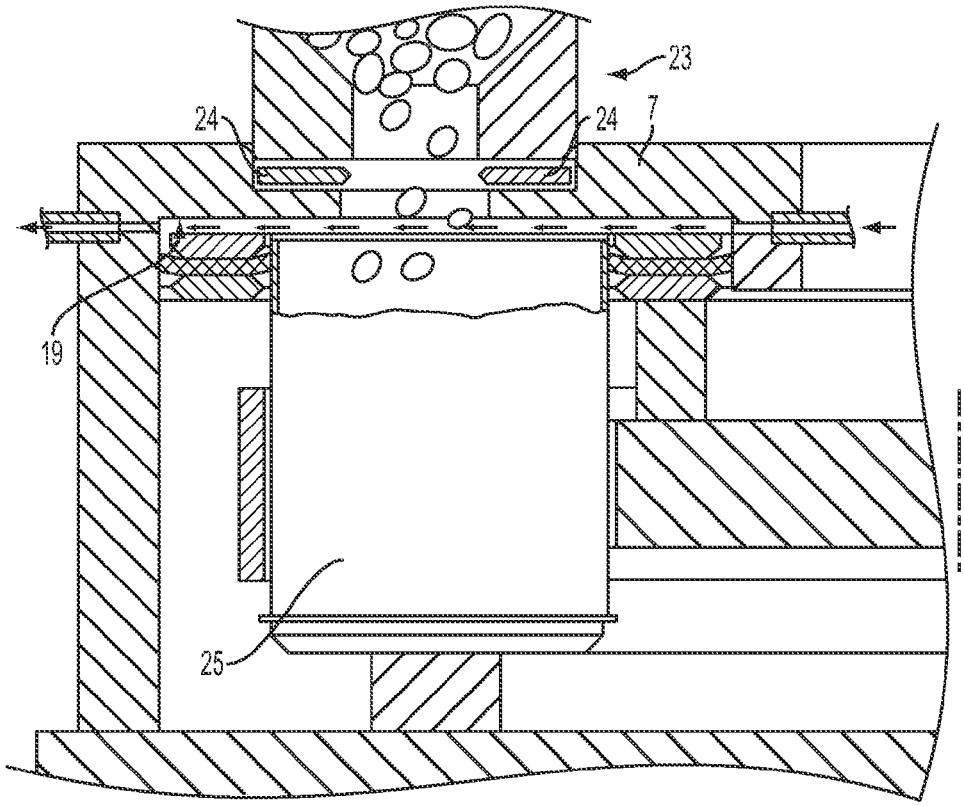
FIG. 3 shows a detailed view of a filling station with a device of the processing position from FIG. 1, as a section (III-III), as a side view

FIG. 3 shows a detailed view of a filling station with inert gas flushing of the processing position shown in FIG. 1, as a section along the plane III-III, and a can 25 which is filled with, for example, salted peanuts, as a partial section in side view.

The upper housing 7 has an opening in which a filling device 23 is mounted. Adjacent to a funnel-shaped filling channel, the filling device 23 has a closing flap 24 which is shown here in the open state. The filling of the can 25 is effected here through the flowing inert gas. Advantageously, an inert gas atmosphere also prevails in the funnel-shaped filling channel.

Figure 4:
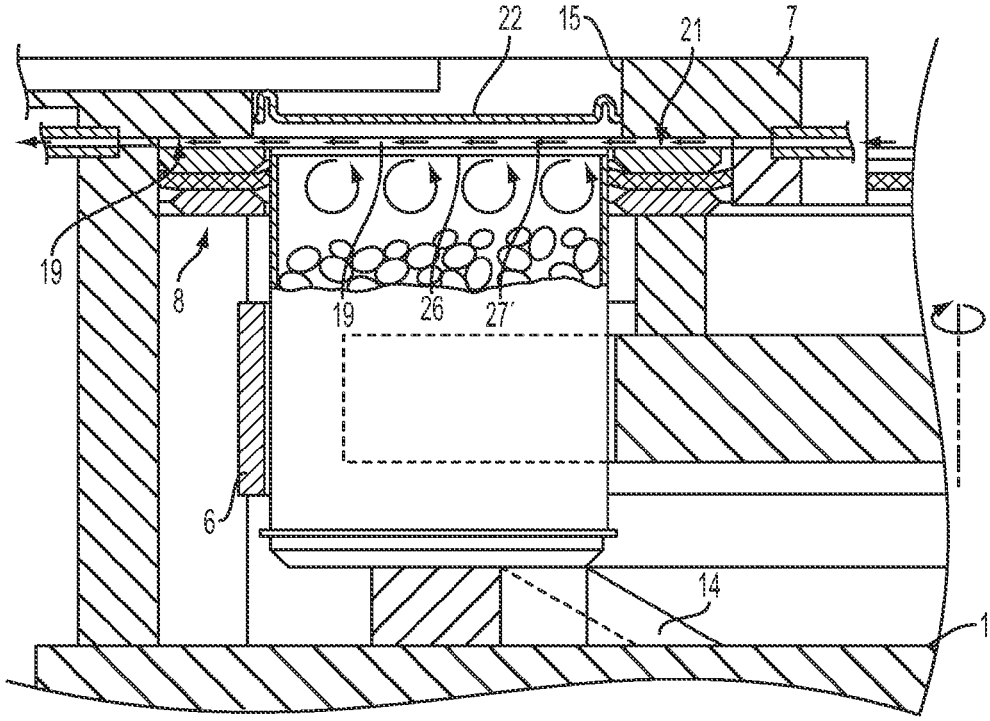
FIG. 4 shows a detailed view of a sealing station with a device of the processing position from FIG. 1 as a section (IV-IV), as a side view.

FIG. 4 shows a detailed view of a sealing station with inert gas flushing of the processing position shown in FIG. 1, as a section along the plane IV-IV, and a filled can 25 which is to be sealed with a closure element 22, as a partial section in side view.

Here, the can 25 is filled, by way of example, with the salted peanuts. If the can 25 has been filled outside the device for inert gas flushing, in the ambient atmosphere, the inert gas flushing also includes the gas in the space between the individual peanuts. If the empty can 25 has already been flushed out with inert gas and/or if the filling process has been effected in an inert gas atmosphere, the scope of the inert gas flushing prior to sealing of the can 25 can be kept small.

The closure element 22 is to be inserted into the introduction opening 15 in such a way that its lower edge extends approximately to the inside 19 of the upper housing 7. Here, the closure element 22 forms a part of the wall which is opposite the filling opening 26 and bounds the flow. Laterally, it rests against the introduction opening 15 all round and seals it substantially from the environment. Here, the inside 19, the closure element 22 and the top 21 of the perforated disc 8 bound a further channel 27' which directs the flowing inert gas in the device for inert gas flushing in the sealing station. The further channel 27', together with the interior of the filled can 25, also forms a substantially closed flushing space for inert gas flushing according to the invention.

In this embodiment, the closure element 22 is a container base which, for example, is pressed by means of a ram not shown in FIG. 3 against a tubular can wall and is temporarily closed. However, the can 25 could equally well also be pressed—by an appropriately formed lifting track—with the filling opening 26 against the closure element 22 and pushed over the upper edge of the upper housing 7. The closure element 22 now laterally freely accessible from all directions could be fastened by means of a conventional sealing device to the tubular wall without problems and the can 25 thus finally sealed.

The can sealed gas-tight can leave the device without impairing the atmosphere in the interior of the can. During transport to the next station, the can passes the lowering ramp 14 and is removed from the perforated disc 8 onto the table top 1.

Until the next closure element 15 is introduced into the introduction opening 15, air from the ambient atmosphere can enter the further channel 27', which is formed here by the inside 19, the perforated disc 8 and the lip seals 16—shown only in FIG. 1. Once the next closure element 22 has been inserted into the introduction opening 15, the air which has entered can be flushed out of the further channel 27' again by the inert gas stream. A next can to be sealed can be transported into the sealing station.

The invention claimed is:

1. A device for flushing at least one can with inert gas, comprising:

an upper housing connected in a stationary manner to a table top and gripping around part of a top of an inner and outer edge of a perforated disc, said perforated disc being rotatable about an axis of rotation and arranged above a turnstile and coaxially therewith at a predetermined distance from the table top, wherein said perforated disc and turnstile are configured to execute the same rotational movements about said axis of rotation;

a lifting device for lifting and lowering said can; and a channel bound by an upper wall formed by said stationary upper housing and a lower wall formed by said rotatable perforated disc, said channel having an inert gas feed pipe and a gas discharge pipe, wherein the lower wall has at least one passage through which a filling opening of the can can be introduced into the channel for the purpose of flushing, and wherein the lower wall can be moved parallel relative to the upper wall.

2. The device according to claim 1, wherein the lifting device comprises a lifting ramp and a lowering ramp.

3. The device according to claim 1, further comprising one or more processing stations, each having an opening contained in the upper wall and a closure element, on which the can be processed.

4. The device according to claim 1, wherein the perforated disc is fastened to the turnstile via a spacer ring.

5. The device according to claim 1, wherein the channel formed by the upper wall and the lower wall is divided into a plurality of channels by radially arranged sealing lips.

6. The device according to any of claims 4 to 5, wherein the inert gas feed pipe is mounted such that the flow therein is generally perpendicular to the axis of rotation.

7. The device according to claim 1, wherein the perforated disc has a seal for sealing a flushing space from the environment of the device.

8. The device according to claim 1, wherein it is equipped with a means for measuring the oxygen content and an adjusting element for controlling the inert gas stream.

* * * * *